United States Patent [19]
Stegmeier
[11] 4,318,254
[45] Mar. 9, 1982

[54] CONCRETE DECK WATER STOP SEAL, DECK FORM BOARD, AND METHOD OF APPLYING FINISHING MATERIAL TO DECK COPING

[76] Inventor: William J. Stegmeier, 1037 Shary Cir., Concord, Calif. 94520

[21] Appl. No.: 130,972

[22] Filed: Mar. 17, 1980

[51] Int. Cl.[3] ..... E02D 27/00
[52] U.S. Cl. ..... 52/169.7; 52/744
[58] Field of Search ..... 52/169.7, 396, 255, 52/102, 744

[56] References Cited

U.S. PATENT DOCUMENTS 3,345,789 10/1967 Tatum ..... 52/255 X
3,605,357 9/1971 Stegmeier ..... 52/98
3,850,403 11/1974 Stegmeier ..... 249/27
3,968,191 7/1976 Stegmeier ..... 264/34
4,004,386 1/1977 Diffenderfer ..... 52/169.7 X

*Primary Examiner*—Price C. Faw, Jr.
*Assistant Examiner*—Carl D. Friedman
*Attorney, Agent, or Firm*—C. Michael Zimmerman

[57] ABSTRACT

A water stop for sealing the joint between a swimming pool wall and an overlying concrete deck is described, which water stop includes a flange useful in applying a finishing layer to the deck coping. The water stop includes a water barrier component that has a flat shelf adapted to seat generally horizontally on the upper end of a pool wall, and a skirt element extending transversely downward from the shelf to seat along the pool wall. A flange projects outwardly from the barrier component beyond its structure and inwardly of the pool, to present a finishing edge for the lower edge of a finishing layer applied to the deck coping surface.

9 Claims, 5 Drawing Figures

CONCRETE DECK WATER STOP SEAL, DECK FORM BOARD, AND METHOD OF APPLYING FINISHING MATERIAL TO DECK COPING

BACKGROUND OF THE INVENTION

The present invention relates to the construction of swimming pools and similar structures and, more particularly, to a water stop seal structure for the joint between the generally vertical wall of a swimming pool or the like and an overlying deck, and a method of using the same to apply a finishing material on the coping surface of the deck.

Many swimming pools are formed by excavating a hole in the earth, generally following the contour desired for the pool and then lining the hole with concrete or other material which will define and retain the configuration desired for the pool. In some instances, the hole is lined with a concrete (typically gunnite) which then is covered with a finishing material to provide a water impervious pool wall. In some instances the interior of the pool is provided with a flexible liner of, for example, vinyl or similar material to provide water impermeability. Preformed fiberglass pools are also finding increasing use as in-ground pools.

Irrespective of the type of pool, a deck often is provided surrounding the pool and overlying the upper end of its generally vertical walls. Such a deck typically is molded in-place from concrete and defines a coping which is actually cantilevered somewhat over the edge of the pool. A water stop seal structure is provided for the joint between the deck and the swimming pool wall.

It is often desired to provide the deck coping surface with a layer of a finishing material, such as "Kool Deck", to form an aesthetically pleasing, water impermeable, and sometimes smooth exterior surface at the pool upper edge. However, it has been relatively time-consuming and expensive to do so, since the coating which forms the surface layer must be applied by hand. Moreover, it requires quite skilled labor to assure that the finishing material surface maintains a desired contour without irregularities.

SUMMARY OF THE INVENTION

The present invention provides a water stop seal structure which simplifies the application of a coating of a finishing material to a coping surface, as well as provides a joint barrier which inhibits seepage of moisture between the deck and pool wall. The invention also includes a new method of providing a coating of finishing material on a deck coping surface, as well as a coping form board especially adapted to cooperate with the water stop seal structure.

In basic terms, the water stop seal structure includes in addition to elements which provide a moisture barrier at the joint between a deck and the upper end of a swimming pool wall, a flange which projects inwardly of the pool beyond its moisture barrier component to a location selected for the lower edge of a finishing layer to be subsequently formed. Most desirably, the flange terminates in a free end which provides a reference edge for a trowelling-type tool or structure usable to provide a desired finished surface on the finishing layer. The distance between the free end of the flange and the barrier component preferably also is carefully selected to define what is, in effect, a depth gauge providing the desired depth for the finishing material. Thus, the flange facilitates application to a uniform depth of the finishing material.

The provision of the flange projecting from the water stop seal also has advantages relating to positioning and using relatively flexible form board of the type described in, for example, my earlier Patent No. 3,967,422. That is, the flange coacts with such a form board to assure proper positioning thereof when the latter is being installed. In this connection, the invention also includes a form board of this type having an indent extending lengthwise thereof for receipt of the water stop flange for such positioning. The channel within the form board and the flange are configured to provide when they are engaged with one another, a seal which will prevent seepage therethrough of the concrete or other settable material from which the deck coping is formed. Most desirably, the free end of the flange is provided with a barb extending along its length for cooperation with the form board to provide such seal.

It is recognized that it takes no great mechanical skill to provide a flange extending outward from a conventional water seal structure. However, it is believed to require inventive facilities to recognize that the provision of such a flange in a particular manner can result in a conventional water stop seal providing the additional function of defining the edge of a finishing material provided on the coping surface of a molded deck. In this connection, the invention also includes a method by which such water stop seal with its flange is utilized to provide the desired surface finishing without surface irregularities and the like.

BRIEF DESCRIPTION OF THE DRAWING

With reference to the accompanying two sheets of drawing.

DETAILED DESCRIPTION OF PREFERRED EMBODIMENTS

The invention will be described in detail in connection with the formation of an in-ground swimming pool utilizing generally conventional techniques. After a hole is excavated in the earth, a vertical wall 12 is formed for the pool by lining the earth with a cement mixture, such as by spraying the wall with gunnite. A thickened concrete portion 14, referred to in the art as a bond beam, is provided around the pool at the top of the vertical side walls to structurally define the peripheral edge of the pool and tie the side walls together. After the concrete forming the pool side walls and bond beam has cured sufficiently, the cavity defining faces of the concrete walls and of the bond beam are covered with a suitable finishing material. In this connection, it is common with concrete pools to finish the upper edges of the wall with a band of tile 16 at the elevation at which the water level is to be maintained in the pool. The tile band can be secured to the upper edge of the pool wall in numerous ways—for example my U.S. Pat. Nos. 3,850,403; 3,968,191; 3,974,620; and 3,987,997 describe various apparatuses and methods for this purpose.

It is now common practice after a tile band is secured to the pool wall, to form a concrete deck overlying the pool wall and extending rearwardly of such pool. Often, such a concrete deck terminates at the pool in a coping surface which is cantilevered somewhat inwardly of the pool wall.

When the pool deck is constructed, its inner end, i.e., that end overlying the pool wall, typically is defined by a form board having a form surface complementary in shape to the configuration desired for the coping surface. The form board provided for this purpose must be sufficiently stiff to confine a moldable mass of concrete or other settable material from which the deck coping is to be formed. Most desirably, the form board is provided in elongate sections which while capable of confining the concrete are sufficiently flexible lengthwise to conform to the various curvilinear contours often desired for free-form pools. As mentioned previously, my earlier U.S. Pat. No. 3,967,422 is directed to this general type of form. The material of such a form can be, for example, "Styrofoam" having a density of about one pound per cubic foot.

Figure 1:
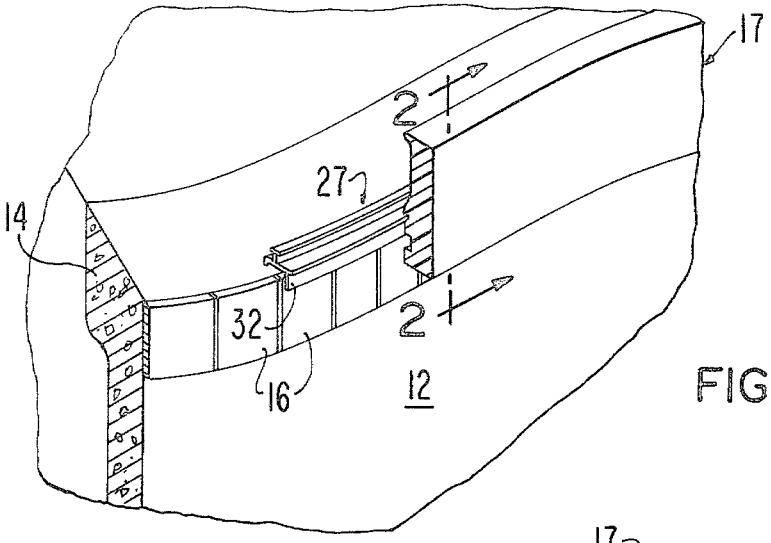
FIG. 1 is a perspective view illustrating the upper end of the vertical wall of a swimming pool with a preferred embodiment of the water stop seal structure and form board of the invention, shown in position but broken away.
Figure 2:
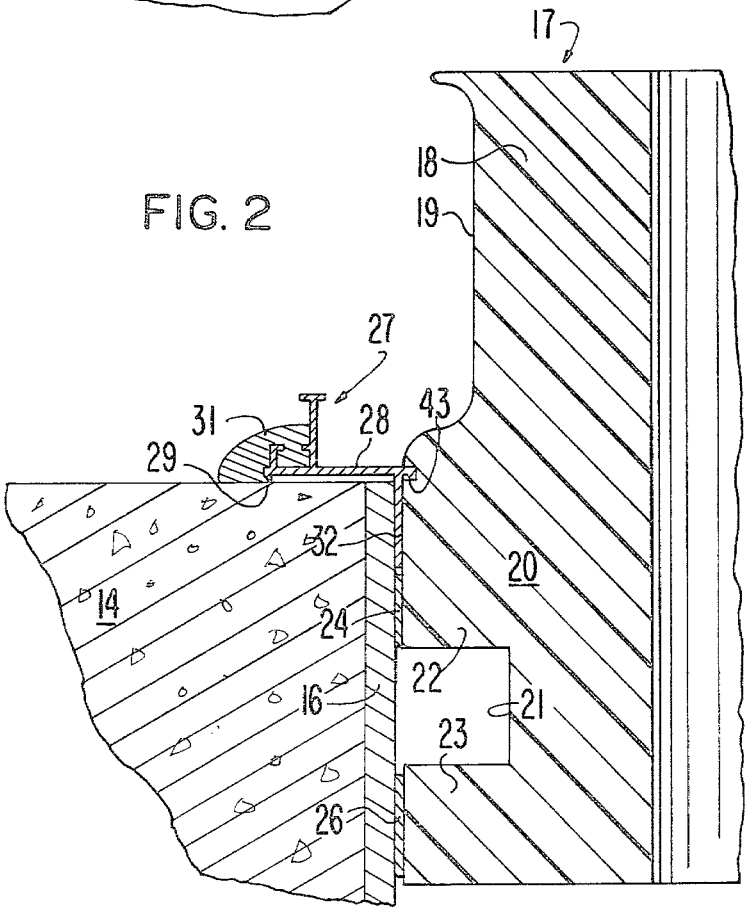
FIG. 2 is an enlarged sectional view taken on a plane indicated by the line 2—2 in FIG. 1.

Such a form board, generally referred to in FIGS. 1 and 2 by the reference numeral 17, is secured adjacent the upper edge of the pool after the band of tiles 16 is applied thereto, with its form surface positioned above the upper end of the pool wall. More particularly, such mold form is composed of a mold section 18 which extends above the upper end of the pool wall to define thereat a form surface 19 which confines the concrete of the deck when poured and provides the inner deck end with a coping surface of a desired configuration. The mold form further includes an attachment section 20 which is integral with the form section and depends therefrom for its length. Such attachment section is relieved at 21 to save material and thereby is provided with two abutment feet 22 and 23 which present an abutment surface facing in the same general direction as form surface 19 for abutment against the pool wall to support the form section. In this connection, the exterior surfaces of the feet 22 and 23 are respectively provided with strips of double-sided adhesive tape 24 and 26 for at least temporarily adhering the mold form to the glaze surface of the tile 16 during installation of the form board. Other, more secure positioning structure, such as that described in my Patent No. 3,987,997, can be provided to assure that the form board retains its position during the formation of the pool deck.

A water stop seal, generally referred to by the reference numeral 27, is provided for the joint between the upper end of the swimming pool wall and the concrete deck. The provision of such a stop is typical of deck constructions of the type being described. U.S. Pat. No. 3,605,357 describes an improved type of stop which because of its simplicity finds fairly wide use. Such a stop includes as is shown in FIGS. 1 and 2, a barrier component which extends along the joint to inhibit seepage of moisture therethrough. Such barrier component has a flat shelf 28 which extends for its length and is adapted to seat generally horizontally on the upper end of the pool wall. In this connection, a relatively short depending lip 29 is provided, extending lengthwise of the shelf. Lip 29 prevents mastic from the mastic body 31 (FIG. 2), to be discussed in more detail infra, from flowing into the space between the pool upper edge and the shelf 28. The barrier component of the water stop also includes a skirt element 29 which extends along its length and projects transversely downward from shelf 28 for seating along the pool vertical wall. In this connection, when the form board is in position as shown in FIGS. 1 and 2, the skirt is sandwiched between such form board and the pool wall.

The water stop seal also includes a pair of spaced apart protruberences 33 and 34—the first of which is materially higher than the second—to be embedded within concrete which cures to form the deck coping. Protruberence 33 is t-shaped in cross-section and has a generally horizontal cross-bar 36 at its upper end. Both of the protruberences 33 and 34 have oppositely turned ledges or ribs 37 and 38 respectively for increasing their bond with the mastic body 31.

As described to this point, the water stop seal structure is generally conventional. In keeping with the invention, however, it further includes a flange 39 which projects outwardly from the barrier component beyond the structure thereof for the length of the seal structure and adjacent its upper edge. Flange 39 is, in effect, an extension of the shelf 28 and includes depending downward therefrom for its full length, a lip or barb 41 engageable with a specially prepared form board as described below. Flange 39 has several functions. It aids in properly positioning a form board at the appropriate level for forming a deck coping. It also acts as a seal which prevents concrete from seeping downward between adjacent tiles during formation of the deck. Perhaps its most unique function is in connection with providing a finishing surface on a deck coping after such coping is formed, as more fully explained herein below.

When a concrete swimming pool is being constructed, the deck is formed typically after the band of tiles 16 is applied to the pool upper wall. In more detail, the water stop seal 27 is positioned along the upper edge of the pool as shown in FIGS. 1 and 2, to provide the desired joint barrier between the deck and pool once such deck is formed. The mastic body 31 is then applied to secure the water stop seal to the upper edge of the pool with sufficient resiliency to allow relative movement between the deck and the pool to accommodate differential thermal expansion and contraction.

The mold form board 17 is placed into position, after the water stop seal structure is installed on the pool edge. An improved mold form is provided, designed to cooperate with the flange 39 of the water stop seal, for positioning and sealing. Such mold form has an indent 43 (FIG. 2) extending lengthwise thereof generally at the boundary between the form and attachments sections 18 and 23 and facing in the same direction as the form and abutment surfaces. Such indent receives the flange 39 upon placement of the form board with its attachment section in engagement with the upper part of the tiles, thereby acting to position the mold form at the proper elevation relative to the pool wall to form the coping surface. Moreover, the indent is provided with a configuration that cooperates with the flange to form a seal and prevent downward passage of concrete or moisture during formation of the deck. In this connection, downward seepage of moisture can interfere with the adherence of the tapes 24 and 26 to the band of tiles, and stain the tile grout. As illustrated in FIG. 2, sealing barb 41 depending downwardly from the flange engages the form board within the indent to enhance the sealing relation between the two components.

Once the form board 17 is properly positioned, and supported in place, the concrete deck can be formed in-place with such form board confining the same at the edge of the pool and defining a desired coping surface. It should be noted that insofar as the method of the present invention is concerned, a major portion of the deck could be formed of blocks or similar material, i.e., formed off-site and placed into position—only the coping surface need be formed in-place.

Figure 5:
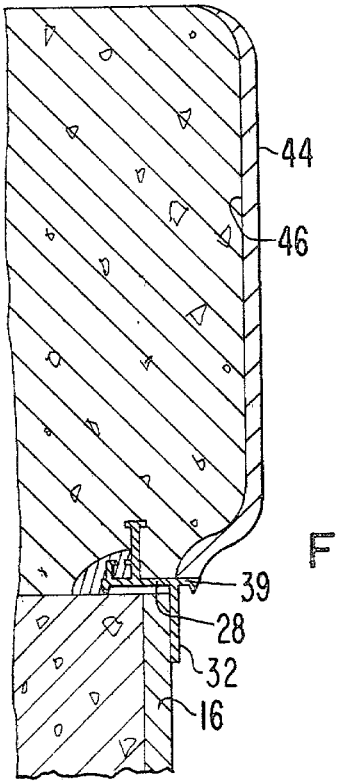
FIG. 5 is an enlarged sectional view of FIG. 4, taken on a plane indicated by the lines 5—5 in FIG. 4.
Figure 3:
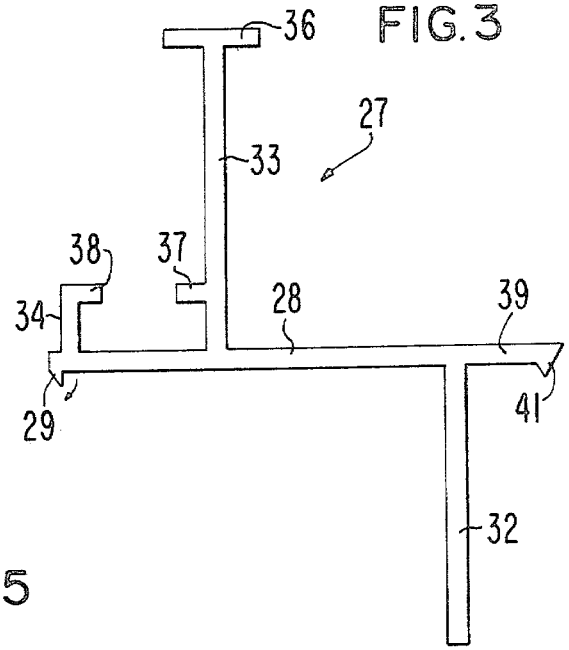
FIG. 3 is a further enlarged sectional view of the preferred embodiment of the water stop seal structure of the invention.

After the pool deck coping has set sufficiently to maintain the coping surface configuration, the form board 17 may be removed in a conventional manner. As a particularly salient feature of the invention, the flange 39 of the water stop seal structure will extend inwardly of the pool beyond the formed coping, a distance which is determined by the width of the flange which is received within the form indent during the coping formation. This flange then becomes useful in applying a finishing layer to the coping surface. More particularly, in projecting outwardly from the remainder of the water stop structure flange 39 presents a finishing edge for the lower end of such a finishing layer. As can be seen from the sectional view of FIG. 5, the finishing layer 44 provided on the generally vertical surface 46 of the concrete coping 47 terminates at the stop flange 39. Thus, the lower edge of such finishing area is defined by a clean, horizontal line and is kept from extending over the faces of the tiles 16 and the grout lines between such tiles.

Figure 4:
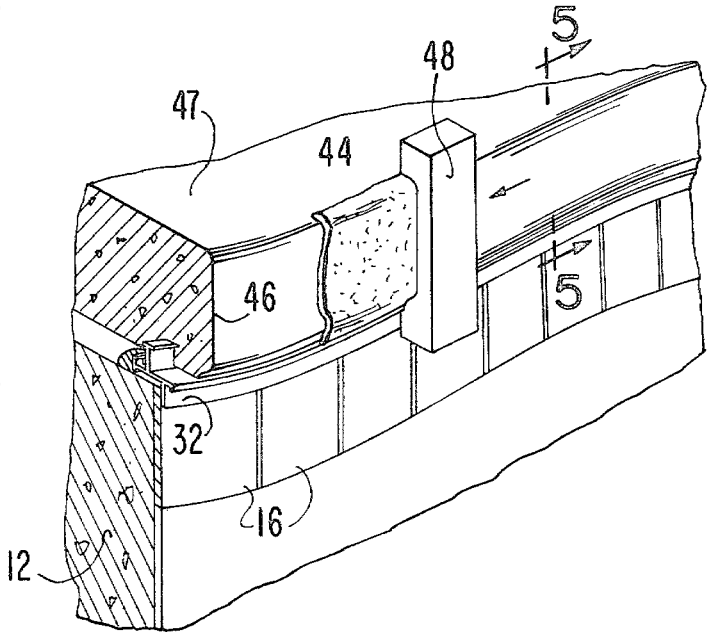
FIG. 4 is a perspective view illustrating steps in the method of the invention.

Most desirably, the free end of the flange 39 terminates a predetermined distance from the water stop barrier component for the full length of the latter. It thereby provides a depth gauge for use in determining the depth to which the settable finishing material from which the layer 44 is formed, is applied. The finishing layer most simply is brought out to the end of the flange as shown, although this is not necessary to the invention from the broad standpoint. The free end of the flange is also made relatively linear along its full length without obstructions or abrupt changes so that it provides a reference edge for use in applying a coating of the finishing material to the coping surface in order to form the finishing layer. Thus, it is usable in a simple manner to assure that the coping surface has a requisite thickness and is formed without surface irregularities. Reference is made to FIG. 4 which illustrates such use. A trowelling tool 48 which can be, for example, a simple piece of wood (a 2×4) having cut into one of its sides, a contour complementary to the desired contour for the finishing layer, can be slid along the reference edge provided by the seal flange 39 during trowelling to provide the desired finished surface. It should be noted that typically it is desired that the upper end of the finishing layer for the coping blend into the horizontal surface provided by the deck, and thus the deck itself can provide the reference location for the upper end of the tool 48. The finished surface which can be provided using such a tool with the flange free end as a reference is illustrated in FIG. 4 on the right hand side of the tool.

As will be recognized from the above, the provision of the flange converts the water stop seal from a simple water stop seal to a structure which not only provides desired water sealing, but also serves to aid and simplify pool construction. And while the invention has been described in connection with preferred embodiments thereof, it will be appreciated by those skilled in the art that many changes and variations can be made without departing from its spirit. It is therefore intended that the coverage afforded applicant be limited only by such spirit as defined by the claims and their equivalent language.

I claim:

1. A water stop seal structure for the joint between a deck and the upper end of a generally vertical wall of a swimming pool or the like wherein said deck defines a generally vertical coping surface overlying said wall, comprising: an elongated barrier component extendable along said joint to inhibit seepage of moisture therethrough; and a flange projecting outwardly from said barrier component beyond the structure thereof for the length of said seal structure and adjacent the upper edge thereof to present a finishing edge defining the lower edge of a finishing layer for said coping surface of said deck, said flange terminating in a free end outwardly of said barrier component providing a reference edge for use in applying a coating of a settable finishing material to said coping surface to form said layer.

2. A water stop seal structure according to claim 1 wherein said free end terminates a predetermined distance from said barrier component for the full length thereof to thereby provide a depth gauge for said settable finishing material.

3. A water stop seal structure according to claim 1 in combination with a mold form board for use in forming said deck coping surface, comprising an elongate form section having a form surface complementary in shape to the configuration of said coping surface to be defined thereby and being sufficiently stiff to confine a moldable mass of settable material from which said surface is to be formed, an attachment section integral with said form section and depending therefrom for the length thereof, presenting an abutment surface facing in the same general direction as said form surface for abutment against a pool wall to support said form section above the upper end thereof during the formation of said coping surface, said mold form board having an indent extending lengthwise generally at the boundary between said form and attachment sections and opening in generally the same direction as said form and abutment surfaces for receipt of said flange of said water stop seal for positioning said mold form; and said water stop seal structure further including a protruberance integral with and extending upwardly from said barrier component to be imbedded within said moldable mass of settable material when said coping surface is formed.

4. A water stop seal structure according to claim 1 in combination with a mold form board for use in forming said deck coping surface, which mold form board comprises an elongated form section having a form surface complementary in shape to the configuration of said coping surface to be imposed thereby and being sufficiently stiff to confine a moldable mass of settable material from which said surface is to be formed, an attachment section integral with said form section and depending therefrom for the length thereof, presenting an abutment surface facing in the same general direction as said form surface for abutment against a pool wall to support said form section above the upper end thereof during the formation of said coping surface, said mold form board having an indent extending lengthwise into said attachment section generally at the boundary between said form and attachment sections and opening in generally the same direction as said form and abutment surfaces for receipt of said flange to cooperate therewith to form a seal preventing passage therebetween of the moldable mass of settable material from which said coping surface is formed.

5. A water stop seal structure according to claim 4 wherein a sealing barb depends downward from the free end of said flange along the full length thereof to engage said form board within said indent in sealing relation.

6. A water stop seal structure according to claim 1 wherein said barrier component includes a flat shelf which extends for the length thereof and is adapted to seat generally horizontally on said wall upper end and a skirt element which extends along the length of said barrier component and extends transversely downward from said shelf for seating along said pool vertical wall upon said shelf being seated horizontally along the upper edge thereof, said flange being provided as an extension of said shelf projecting inwardly of said pool upon said seal structure being seated on the upper edge thereof.

7. A water stop seal structure according to claim 6 wherein said flange terminates a predetermined distance outwardly of said skirting for the full length thereof to provide both a reference edge and a depth gauge for use in applying a coating of a settable finishing material to said coping surface to form said layer.

8. A method of applying a finishing layer to the coping surface of a deck overlying the upper end of a generally vertical wall of a swimming pool, comprising the steps of: providing a water stop seal structure along said upper end of said generally vertical wall prior to placing a deck overlying said upper end, which structure includes an elongated barrier component to inhibit seepage of moisture between said wall upper end and said deck, and a flange projecting outwardly from said barrier component and extending along the length thereof to define a finishing edge for said finishing layer; sandwiching said water stop seal structure between said wall upper end and a deck overlying said upper end; and thereafter placing a coating of a settable finishing material on said coping surface of said deck and extending the same downward to said flange finishing edge to provide said finishing layer, using said flange free end as a guide for a tool to define the configuration of said surface.

9. A method according to claim 8 wherein said flange free end terminates a predetermined distance from said barrier component for the full length thereof to provide a depth gauge for said finishing material, and said step of placing said coating of a settable finishing material on said coping surface includes using said flange to define the depth on said coping surface of said settable finishing material.

* * * * *